US006626165B1

(12) United States Patent
Bhogal

(10) Patent No.: US 6,626,165 B1
(45) Date of Patent: Sep. 30, 2003

(54) PAINTBALL GUN

(76) Inventor: Kalvinder Singh Bhogal, 699 Willowbank Trail, Mississauga, Ontario (CA), L4W 3L6

( * ) Notice: Subject to any disclaimer, the term of this patent is extended or adjusted under 35 U.S.C. 154(b) by 0 days.

(21) Appl. No.: 10/134,928

(22) Filed: Apr. 29, 2002

(51) Int. Cl.[7] ..... F41B 11/32
(52) U.S. Cl. ..... 124/77; 124/73; 124/76
(58) Field of Search ..... 124/73, 74, 76, 124/77

(56) References Cited

U.S. PATENT DOCUMENTS

| | | | | | |
|---|---|---|---|---|---|
| 2,568,432 | A | * | 9/1951 | Cook | 124/65 |
| 4,362,145 | A | * | 12/1982 | Stelcher | 124/32 |
| 5,063,905 | A | * | 11/1991 | Farrell | 124/72 |
| 5,727,538 | A | | 3/1998 | Ellis | 127/77 |
| 5,878,736 | A | | 3/1999 | Lotuaco, III | 124/71 |
| 5,881,707 | A | | 3/1999 | Gardner, Jr. | 124/77 |
| 6,003,504 | A | | 12/1999 | Rice et al. | 124/73 |
| 6,439,217 | B1 | * | 8/2002 | Shih | 124/77 |
| 2002/0170551 | A1 | * | 11/2002 | Kotsiopoulos et al. | 124/54 |

FOREIGN PATENT DOCUMENTS

| | | | | |
|---|---|---|---|---|
| EP | 1197723 A2 | * | 4/2002 | F41B/11/32 |
| WO | WO 00/75594 A1 | * | 12/2000 | F41B/11/02 |

* cited by examiner

*Primary Examiner*—Charles T. Jordan
*Assistant Examiner*—John W. Zerr
(74) *Attorney, Agent, or Firm*—Gifford, Krass, Groh, Sprinkle, Anderson & Citkowski, P.C.

(57) ABSTRACT

A gas powered gun for firing paintballs dispensed from a magazine includes a bolt slidable within a breech section, a slidable hammer connected to the bolt and a spring to bias the hammer towards a forward firing position. A trigger operates an electrical circuit that includes a solenoid adapted to move a sear mechanism so as to release the hammer when the trigger is pulled. The solenoid has an actuating member movable from a lower position corresponding to the cocked position to a raised firing position at which the sear mechanism is disengaged from the hammer. An annular sealing member mounted at the bolt's front end is engageable with the barrel. The preferred sear member is elongate and pivots about a central transverse pivot axis. This sear member is engaged at its front end by the actuating member in order to release the hammer.

15 Claims, 5 Drawing Sheets

PAINTBALL GUN

BACKGROUND OF THE INVENTION

This invention relates to gas-powered guns, and in particular, guns suitable for firing balls such as paintballs dispensed from a magazine.

A variety of guns have been developed in recent years for firing balls using compressed gas. Many of these guns have been developed for the purpose of shooting paintballs which typically include a special, liquid mixture encased in a gelatin layer that will rupture upon impact of the ball with a target. These guns typically are attached to a pressurized gas source generally in the form of a metal cylinder containing a gas such as $CO_2$, nitrogen or air.

In more recent years, guns for firing paintballs have been developed which are electronically operated. Typically, these guns have a pivotable trigger mounted in the gun body and able to operate a small electrical switch such as a microswitch that is part of an electronic operating and control circuit. In addition to the switch, the electronic circuit can include a suitable circuit board that can be mounted in the handle of the gun, for example, and the circuit can further include a standard battery to provide a source of electrical power.

One known electronic paintball gun is that described and illustrated in U.S. Pat. No. 5,878,736 issued Mar. 9, 1999 to Brass Eagle, Inc. In this known gun, paintballs are loaded through a feed port formed in the top of the breech section at the rear of the barrel. Pressurized gas to propel the paintballs is provided by means of a regulator at the rear end of the gun. Lower pressure gas is provided by means of a second regulator and this gas is used to move the gun bolt and one paintball forwardly to the firing position. This gun is controlled electronically by a circuit board mounted in the grip of the gun and powered by batteries. This known gun also employs a double-acting pneumatic cylinder which has a piston rod with a so-called carrier at its rear end. This carrier can be connected to a hammer by means of a sear which is pivotably mounted on the hammer. There is also a coil spring arranged between the carrier and the hammer to bias these two parts away from each other. Also, the carrier is rigidly attached to the bolt by means of a bent link member. This known electronic paintball gun is relatively complex and requires the use of a number of moving parts for its operation. Also, as indicated, it requires the use of two separate regulators in order to provide pressurized gas at two different pressures.

Another electronic paintball gun is described and illustrated in U.S. Pat. No. 6,003,504 issued Dec. 21, 1999 to NPF Limited. This gun also requires the use of first and second gas pressure regulators and the gun is relatively complex in its construction. The gun employs a pneumatic control valve which receives gas under pressure and directs the gas selectively to a pneumatic ram mounted for sliding movement in a cylinder in the gun between a retracted, cocked position and a forward position in which it opens a valve to admit high pressure gas from a gas chamber to the barrel to fire a paintball. An electrical switch operated by the trigger is connected to an electronic control circuit that is battery operated.

Another known paintball gun or marker is a semi-automatic gun sold under the trade-mark FOKUS by Mokal Inc. of Mississauga, Ontario, Canada. This gun employs a venturi bolt that is connected rigidly to a hammer by means of a pin and that therefore moves with the hammer. The hammer is biased towards its forward firing position by means of a coil spring. A pivoting sear member is able to hold the hammer in the cocked position until the trigger is pulled. When the hammer is released by the sear, it is advanced quickly to its forward, firing position where it strikes the stem of a poppet valve, thereby releasing relatively high pressure gas into the barrel to fire a paintball. It is also known to replace the mechanical trigger mechanism of this gun with an electronic switch operated by the trigger and an electronic control circuit that includes a solenoid. In the known electronic firing mechanism, the solenoid is arranged generally horizontally with its movable actuating member moving in a horizontal direction to engage a special sear with a downwardly extending leg. This special sear has an upwardly sloping leg to engage a recess or notch formed in the hammer. This sear is pivotably mounted by a pivot pin where the downward leg and the sloping leg of the sear meet. This sear is biased to its cocking position by a small spring.

Although the aforementioned known construction for operating a gun firing sear by means of a solenoid will function, this known firing mechanism does suffer from some disadvantages. The small spring employed to bias the sear to its cocked position is subject to wear. Also, in this known arrangement, the sear is biased to press against the actuator of the solenoid and therefore the solenoid is subjected to shock when the gun is fired. Furthermore, this known construction requires the solenoid to be adjusted carefully to its correct position in the gun frame and if this adjustment is not properly done, this can result in unreliability in operation of the gun. In addition, the number of shots that can be obtained from a battery charge is limited and it would be desirable to obtain many more shots from a battery charge. Also, this known construction requires a substantial amount of the internal structure of the gun handle to be removed in order to accommodate the gun firing mechanism, including the solenoid and the sear and this results in a handle which is relatively weak and subject to vibration.

Another problem that has arisen from electronically operated paintball guns is that the compressed gases used to propel the paintball from the barrel can undesirably travel upwardly through the ball feed port, the feed tube and the ball hopper, thereby impeding loading of the paintballs through the feed tube. This problem appears to have arisen in part due to the faster cycle time that can be achieved with electronically operated paintball guns. This problem of upwardly flowing exhaust gases impeding loading arises even though it is known to provide a seal on the bolt to prevent exhaust gases from passing along the side of the bolt and escaping in this manner. In the prior art guns, the seal, if any, rather loosely engages in the breech, thus allowing for back-pressure. The known seal cannot simply be made tighter against the bore in the breech as this would increase the drag on the bolt and would result in inconsistent paintball velocities since the hammer may not hit the valve stem hard enough.

It is an object of the present invention to provide an improved gas-powered gun for firing balls, such as paintballs, dispensed from a magazine, this gun being electrically operated and employing a solenoid to operate the sear mechanism wherein the solenoid has a sear engaging member movable from a lowered position corresponding to the cocked position of the hammer to a raised firing position at which the sear mechanism is disengaged from the hammer.

It is a further object of the present invention to provide a gas-powered gun for firing balls, such as paintballs, which employs a barrel with an open-ended, ball receiving chamber formed in a rear end section thereof and a bolt having a sealing member mounted on a front end thereof and engageable with the barrel, this arrangement effectively preventing backward flow of the exhaust gases after the gun is fired.

SUMMARY OF THE INVENTION

According to one aspect of the invention, a gas powered gun for firing balls dispensed from a magazine into the gun is provided, this gun being adapted to be connected to a source of pressurized gas. The gun comprises a gun body, including a gun handle, a breech section and a barrel with the breech section being connected to a rear end of the barrel and capable of receiving one ball at a time through a ball feed port from the magazine. The bolt is slidable within the breech section to advance a ball to a firing position and close off the feed port. A hammer is slidable in a chamber formed in the gun body and there are means for biasing the hammer towards a forward firing position. A trigger is movably mounted on the gun body as is a sear mechanism. The gun has an electrical control circuit, including a switch operable by the trigger. This circuit is adapted for connection to a power source. The gun has a sear mechanism including an elongate sear member movably mounted in the gun body. The sear mechanism is adapted to engage and hold the hammer in a rear, cocked position thereof. The sear member is substantially straight from one end thereof to an opposite end thereof. A solenoid is mounted in the gun body, is operated by the control circuit, and is adapted to move the sear mechanism so as to release the hammer when the trigger is pulled. The hammer, when released, slides rapidly to its forward firing position. The solenoid includes a sear engaging member movable from a lowered position corresponding to the cocked position of the hammer to a raised firing position at which the sear member is disengaged from the hammer. A pressurized gas circuit is able to deliver pressurized propellant gas from the source to the barrel of the gun for propelling one ball at a time therefrom and this gas circuit includes a valve. When the hammer is moved to its forward firing position, it strikes the valve to open it, thereby releasing the propellant gas into the barrel.

In a preferred embodiment, the sear member is pivotably mounted and the sear mechanism includes a spring for biasing the sear member into engagement with the hammer so as to hold the hammer in the rear, cocked position.

According to another aspect of the invention, a gas powered gun for firing balls comprises a gun body including a gun handle, a breech section with an elongate breech chamber formed therein, and a barrel connected to a front end of the breech section. A bolt is slidably mounted in the breech chamber and a hammer is slidably mounted in the gun body. The hammer is slidable from a rear, cocked position to a front firing position. A spring device is provided to slide the hammer rapidly to the front firing position when the gun is fired. The gun further includes a trigger movably mounted on the gun body and a sear mechanism including a sear member movably mounted in the gun body and adapted to engage and hold the hammer in its rear cocked position until the gun is fired by pulling the trigger. The sear member is substantially straight from one end thereof to an opposite end thereof. There is an electrical circuit for moving the sear member to a hammer releasing position, this circuit including a solenoid mounted in the gun body and a switch operated by the trigger. When the trigger is pulled, the solenoid causes the sear member to be moved and thereby release the hammer for sliding to the front firing position. The solenoid includes an actuating member which, when the gun is upright with its barrel extending horizontally, is movable from a lowered position to a raised position so that the actuating member moves the sear member to release the hammer. The gun further includes a pressurized gas circuit for delivering pressurized propellant gas from a source of pressurized gas to the barrel for propelling a ball therefrom when the hammer is moved to its front firing position.

In a preferred embodiment, the sear member is mounted in the gun body so as to be pivotable about a transverse axis located centrally along the length of the sear member. Also, the actuating member is positioned to engage a front end section of the sear member when it is moved to its raised position.

According to a further aspect of the invention, a gas powered gun for firing balls is adapted to be connected to a source of pressurized gas and comprises a gun body including a breech section having an elongate bolt chamber and capable of receiving one ball at a time through a ball feed port provided therein. The gun also has a barrel having a rear end section rigidly connected to this breech section and an open-ended, ball-receiving chamber formed in the rear end section. A bolt is slidable within the bolt chamber to advance a ball into the ball-receiving chamber, where the ball is in its firing position, and to close off the feed port. The bolt has a sealing member mounted on the front end thereof and engageable with the barrel. A trigger is movably mounted on the gun body and the gun also has a hammer mechanism including a hammer slidably mounted in the gun body and means for moving the hammer from a cocked position to a firing position when the trigger is pulled. A gas valve system is mounted in the gun body and is connectible to the source of pressurized gas. This valve system is adapted to release pressurized gas in order to fire a ball from the barrel when the hammer moves to the firing position and thereby opens the gas valve system. When the ball is advanced into the ball-receiving chamber of the barrel, at least a major section of the ball is located within this chamber.

Preferably the sealing member is an annular seal that extends about the circumference of the front end of the bolt and the front end of the bolt is slidable into the rear end section of the barrel so that the sealing member can sealingly engage an inner surface of the barrel.

Further features and advantages will become apparent from the following detailed description taken in conjunction with the accompanying drawings.

DETAILED DESCRIPTION OF PREFERRED EMBODIMENTS

Figure 1:
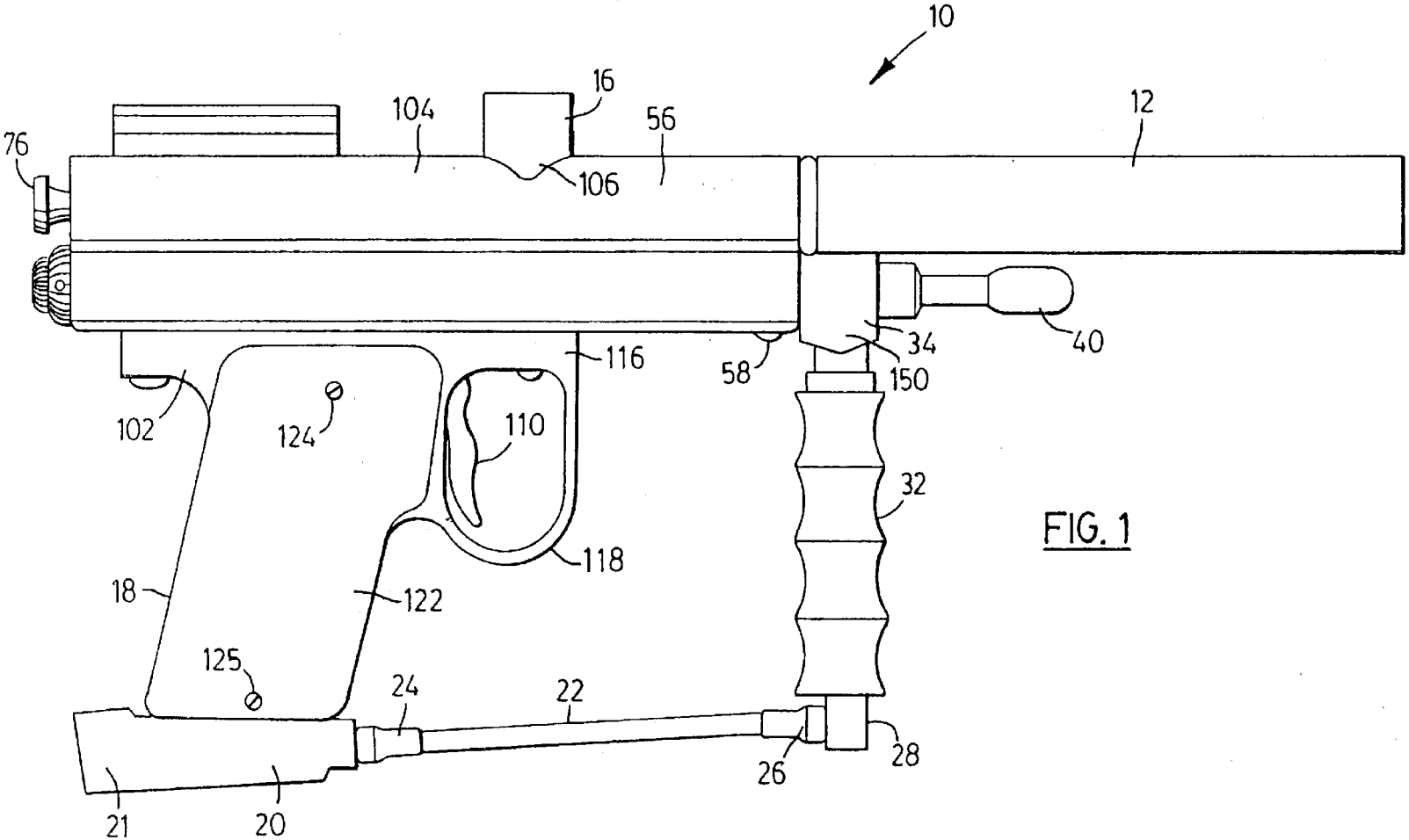
FIG. 1 is a right side view of a paintball gun or marker constructed in accordance with the invention, the gun being shown without a standard compressed gas cylinder connected thereto.
Figure 5:
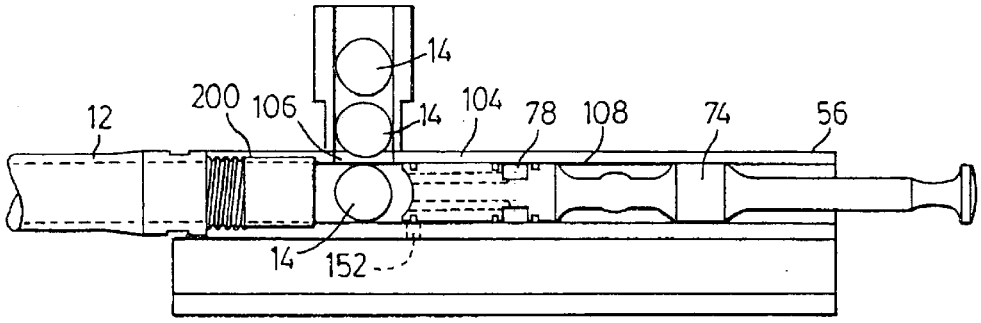
FIG. 5 is a schematic side elevation showing the loading of a paintball into a breech chamber and showing the bolt in its retracted or cocked position.
Figure 6:
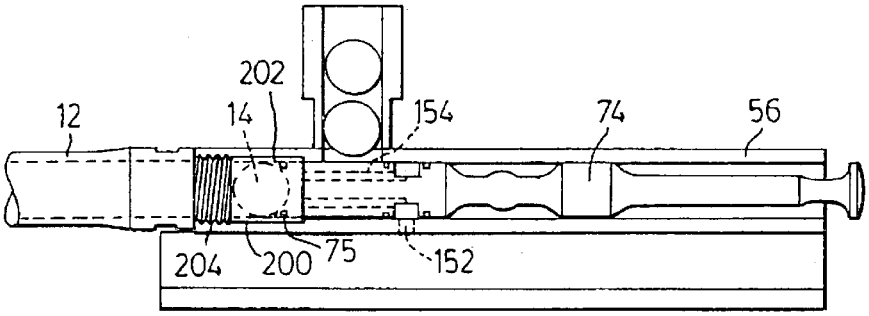
FIG. 6 is a schematic illustration similar to FIG. 5 but showing a paintball in a firing position in a rear section of the barrel with the bolt advanced to its front firing position.

As illustrated in FIG. 1, a gas powered gun or marker 10 constructed in accordance with the invention is capable of firing balls, typically so called paintballs through its barrel 12. Three of these paintballs 14 are illustrated in FIGS. 5 and 6 of the drawings. The paintballs are typically dispensed from a standard paintball magazine or bulk loader (not shown) into the breech of the gun through a feed tube 16. The magazine or bulk loader can be of standard construction and accordingly a detailed description thereof is deemed unnecessary in the present invention. The gun 10 is adapted to be connected to a source of pressurized gas, typically in the form of a compressed gas cylinder holding $CO_2$ or air. These cylinders, which are sold in various sizes, can again be of standard construction. The compressed gas cylinder is typically attached by a suitable connector to the base of the gun handle 18. The illustrated gun 10 has rear bottle adaptor 20 which can be attached by means of two screws (not shown) to the bottom of the handle 18. The rear end section 21 is formed with internal threads to permit the standard gas cylinder to be attached in a sealing manner. The front end of the adaptor is formed with a threaded socket to permit attachment of a flexible compressed gas hose 22 which can be a Teflon hose. This hose is equipped with threaded connectors 24, 26 at opposite ends thereof. The hose member 22 is shown separately in FIG. 3. The front end of hose 22 is detachably connected to an elbow connector 28 which is internally threaded on one side to receive the hose connector 26 and which has external threads at 30 to allow connection to a hollow foregrip member 32. An internal passage extends vertically the length of the foregrip 32 for the passage of the compressed gas into a generally T-shaped adaptor 34. A reduced, upper end section of the foregrip 32 is formed with connecting threads 36 (see FIG. 3) which connect to internal threads in the adaptor 34. Also, an O-ring seal 38 is provided in a groove formed at the upper end of the foregrip in order to seal the joint between the foregrip and the adaptor.

Figure 3:
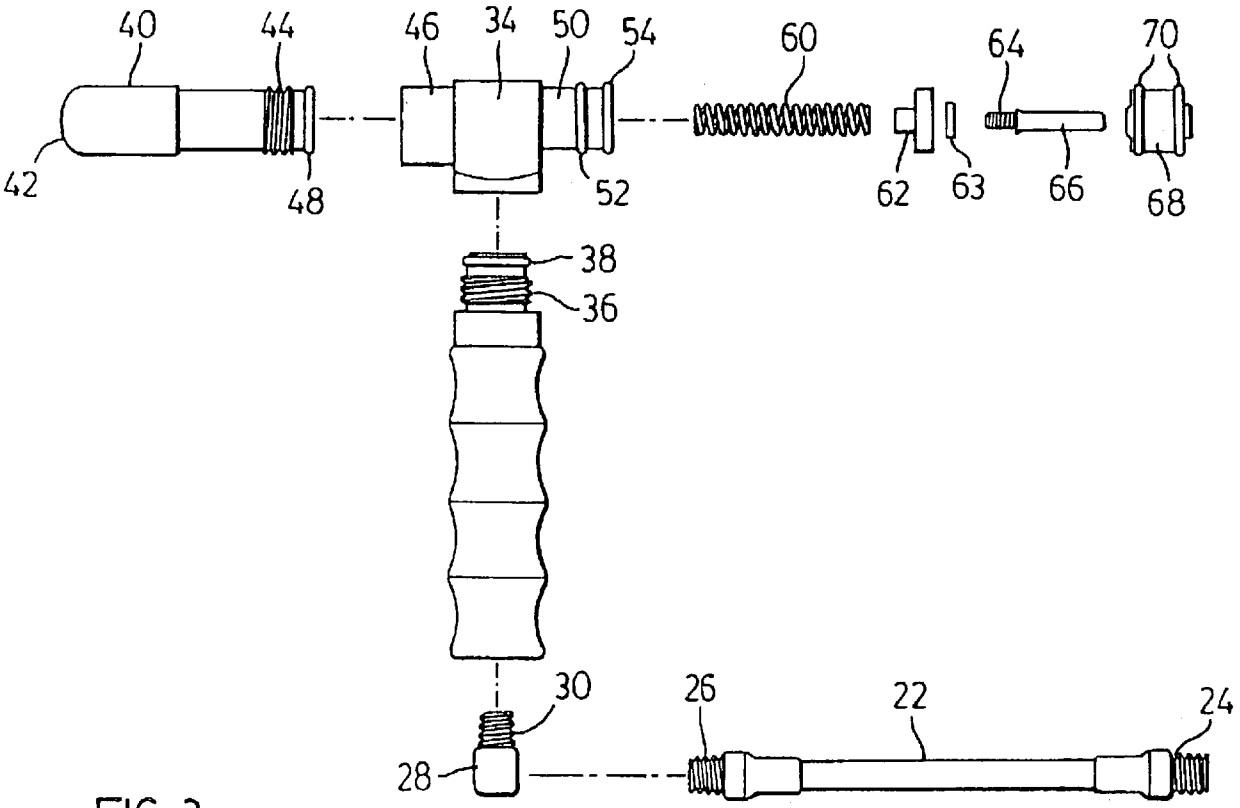
FIG. 3 is a parts diagram illustrating a number of components used in the gun of FIG. 1 separately and the manner that they are attached, these components including a foregrip, a valve spring and a valve body.
Figure 4:
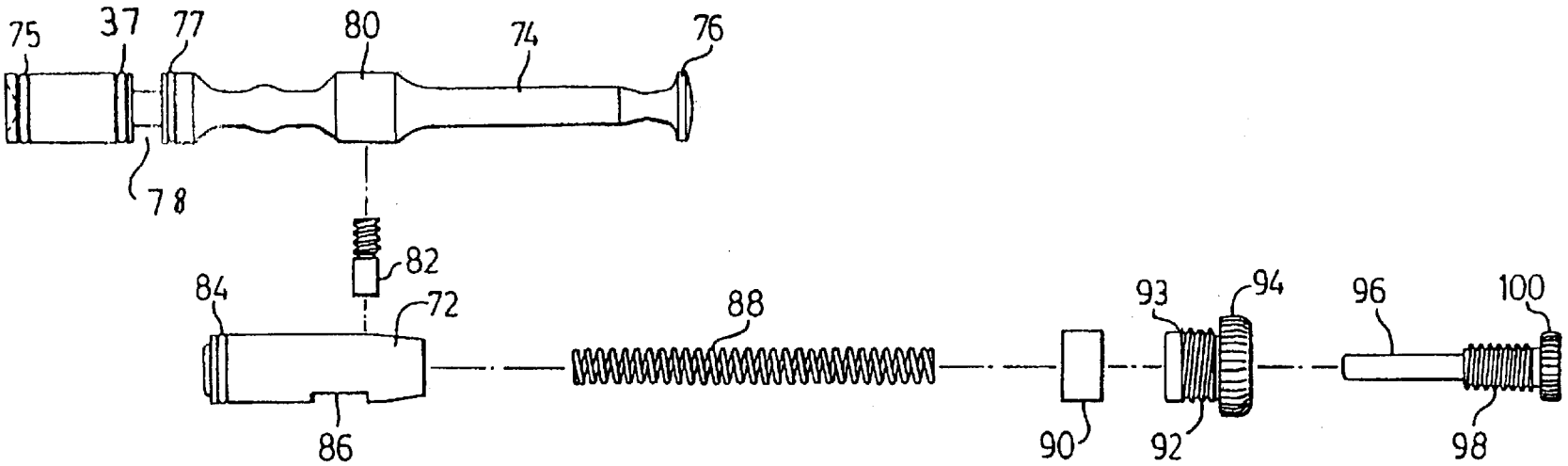
FIG. 4 is a further parts diagram illustrating additional components of the gun of FIG. 1 including a bolt and a hammer.

Connected to the front end of the adaptor is a volumizer 40 having a closed front end 42 and containing a compressed gas chamber for holding a suitable volume of compressed gas to enable proper firing of the gun. External threads are formed at 44 to enable the volumizer to be detachably connected to the adaptor 34 which has internal threads formed in front end section 46. Also, an O-ring seal 48 can be mounted at the rear end of the volumizer to seal the joint between the volumizer and the adaptor. On rear extension 50 of the adaptor, there are two suitable, spaced apart grooves to accommodate two O-ring seals 52 and 54 and these act to seal the joint between the adaptor and an elongate receiver member or housing 56 shown in FIG. 1. The rear extension 50 is connected to the front end of the receiver member by means of a screw 58 that extends through a hole formed in the bottom of the receiver member. The rearward extension 50 is formed with a cylindrical cavity that provides a seat for the front end of a valve spring 60. It will be understood that this spring, as well as the other valve components shown to the right of the spring in FIG. 3 are housed within a horizontal passageway formed in the lower portion of the receiver member 56. It will also be understood that all of the components and items shown in FIG. 3 and also in FIG. 4 are used, for example, in the known paintball marker sold under the trade-mark FOKUS by Mokal Inc. of Mississauga, Ontario, Canada. Accordingly, a detailed description of these components is deemed unnecessary for purposes of the present application and the present description of these components is simply provided herein for a clear understanding of the operation of a gun or marker which can incorporate the features of the present invention.

The rear end of the spring 60 engages a valve seat 62 in which is mounted a valve cup seal 63. Connected to the valve seat by a threaded end section 64 is an elongate solid valve stem 66. The valve stem cooperates with and extends through a valve body 68 on which are mounted two O-ring seals 70 located at opposite ends. It will be understood that when the gun is fired, a hammer 72 illustrated in FIG. 4 will advance rapidly and forwardly, striking the rear end of the valve stem and thereby opening the valve to release propellant gas into the barrel of the gun and to re-cock the hammer.

Turning to FIG. 4, this figure illustrates the combined bolt and hammer mechanism which move together with the gun 10. The illustrated bolt 74 is a so called venturi bolt of known construction per se. It has a knob 76 at its rear end so that the gun can be manually cocked. Mounted on this bolt are three O-ring seals indicated at 37, 75 and 77. The O-ring seals are mounted in annular grooves formed around the bolt. An annular groove 78 is formed on the bolt between the seals 37, 77. The bolt has a relatively short central section 80 which is formed with a threaded hole to receive a connecting pin 82. If desired, a set screw (not shown) can be used to hold the pin in place. The pin 82 extends into an unthreaded hole formed in the top of the hammer 72 and there is a snug, sliding fit between the bottom portion of the pin and the hammer. The hammer has its own O-ring seal 84 arranged on its front end in a suitable annular groove. Also, a recess or notch 86 is formed in the bottom fo the hammer for cooperation with the sear of the gun. There are means for biasing the hammer 72 towards a forward, firing position and the preferred biasing means is an elongate, coil spring 88. It will be understood that the bolt 74 is arranged in the upper half of the receiver member 56 while the hammer and the spring 88 are located in a cylindrical passageway formed in the bottom half of the receiver member. A suitable slot is formed in the member 56 to allow the pin 82 to move with the bolt and hammer. Positioned at the rear end of the spring is a rear bumper 90 made of a suitable elastomeric material such as rubber. Holding the bumper in the receiver member is an end cap 92 having external threads at 93 that can be screwed into threads formed in the receiver member. The end cap is formed with a knurled, wider end portion at 94 to permit the end cap to be turned manually. Mounted in the end cap is an elongate velocity adjustor 96 which has a threaded section 98 that engages threads formed inside the end cap. This adjustor is also fitted with a knurled end at 100 to permit turning of the adjustor manually. By turning the adjustor and thereby changing the position of this member, the user is able to adjust the velocity at which the hammer is driven by the spring 88 to its front, firing position.

It will be understood that the receiver member 56 and a lower gun handle section 102 together form a gun body to which the rear end of the barrel 12 is attached. The receiver member 56 includes a breech section located at 104 which is connected to a rear end of the barrel 12 and is capable of receiving one ball at a time through a ball feed port 106 from the magazine. The breech section is formed with an elongate, bolt chamber 108 in which the bolt is slidable from a retracted or cocked position shown in FIG. 5 to a front, firing position shown in FIG. 6. When the bolt 74 is in its retracted position, a paintball is free to drop into the bolt chamber as shown in FIG. 5. When the trigger is pulled and the gun is fired, the bolt slides quickly within the breech section to advance a paintball to the firing position shown in FIG. 6. The advancement of the bolt also closes off the feed port 106.

The gun is fired by means of a standard, pivoting trigger 110 that is movably mounted on the gun body. The preferred paintball gun 10 is fired by means of a known electrical control circuit which can include an electronic circuit board 112, a capacitor 113, and an electrical switch such as microswitch 114 indicated in dashed lines in FIG. 2. The circuit board 112 can be mounted in an opening formed in handle frame 116 which includes a trigger guard 118. Mounted in front of the circuit board in the handle is a suitable battery such as a nine volt battery 120, access to which can be gained by removing one of two handle grip members 122, one of which can be seen in FIG. 1. The two grip members are attached to the handle frame by means of two screws 124 and 125. The handle grip is not shown in FIG. 2 so that the electrical circuit components in the handle frame can be seen.

It will be understood that the microswitch is closed by pressing on the trigger 110 and the power source for the circuit is provided by the battery.

The aforementioned electrical control circuit is able to operate a solenoid 126 that is mounted in the handle frame above the microswitch. Located generally above this solenoid is a sear mechanism, indicated generally by reference 128 that includes an elongate, pivoting sear member 130. The sear mechanism is pivotably mounted in the gun body 102 by means of a pivot pin at 132. This pivot pin is preferably located at a central section of the sear member and the pin defines a transverse pivot axis about which the sear member can pivot. The sear mechanism 128 is adapted to engage and hold the hammer 72 in its rear, cocked position. The sear mechanism preferably includes spring means which can take the form of a coil spring 134, a lower portion of which is located in a cylindrical cavity formed in the handle frame. The preferred spring engages a rear end section 136 of the sear member while the sear engaging member or actuating member 138 of the solenoid is positioned to engage a front end section 140 of the sear member. It will be understood that the coil spring 134 biases the sear member into engagement with the hammer 72 so as to hold the hammer in the rear, cocked position (corresponding to the position of the bolt shown in FIG. 5). The solenoid 126 on the other hand is adapted to move the sear mechanism so as to release the hammer when the trigger is pulled, the hammer when released sliding rapidly to its forward firing position (corresponding to the position of the bolt shown in FIG. 6).

The gun 10 includes a gas powered circuit indicated generally by reference 150 for delivering pressurized propellant gas from a source for this gas, for example, a gas cylinder, to the barrel 12 for propelling one ball at a time therefrom. This gas circuit includes the above described rear bottle adaptor 20, the hose 2, the elbow 28, the foregrip 32, the adaptor 34 with its attached volumizer 40. In addition, of course, this gas circuit includes the valve stem 66 and the valve body 68 as well as the valve seat 62 and seal 63. The hammer, when it is moved to the forward firing position strikes the rear end of the valve stem which is part of the valve, thereby opening the valve and releasing propellant gas into the bolt chamber from which it flows into the barrel. This relatively high pressure gas is able to pass upwardly into the bolt chamber through connecting passageway 152 indicated in dash marks in FIGS. 5 and 6. Because the bolt will then be in the position shown in FIG. 6, the pressurized gas flows into the annular groove 78 and then through a number of longitudinally extending passageways 154 distributed evenly about the central axis of the bolt. In this way, the high pressure gas passes into the rear end of the barrel resulting in the paintball being shot from the barrel. Note also that the gas delivery system can readily be constructed in a known manner so that when the gun is fired, not only is high pressure propellant gas delivered to the barrel by the valve but also some of this gas is delivered into the cylindrical chamber that houses the hammer in the region in front of the hammer, thus driving the hammer rearwardly to its cocked position. For this reason, the hammer is fitted with the aforementioned O-ring seal 84 on its front end, this seal preventing the high pressure gas from passing along the sides of the hammer. The rearward movement of the hammer also forces the bolt back to its rearmost position (shown in FIG. 5), thereby permitting the loading of another paintball.

Figure 2:
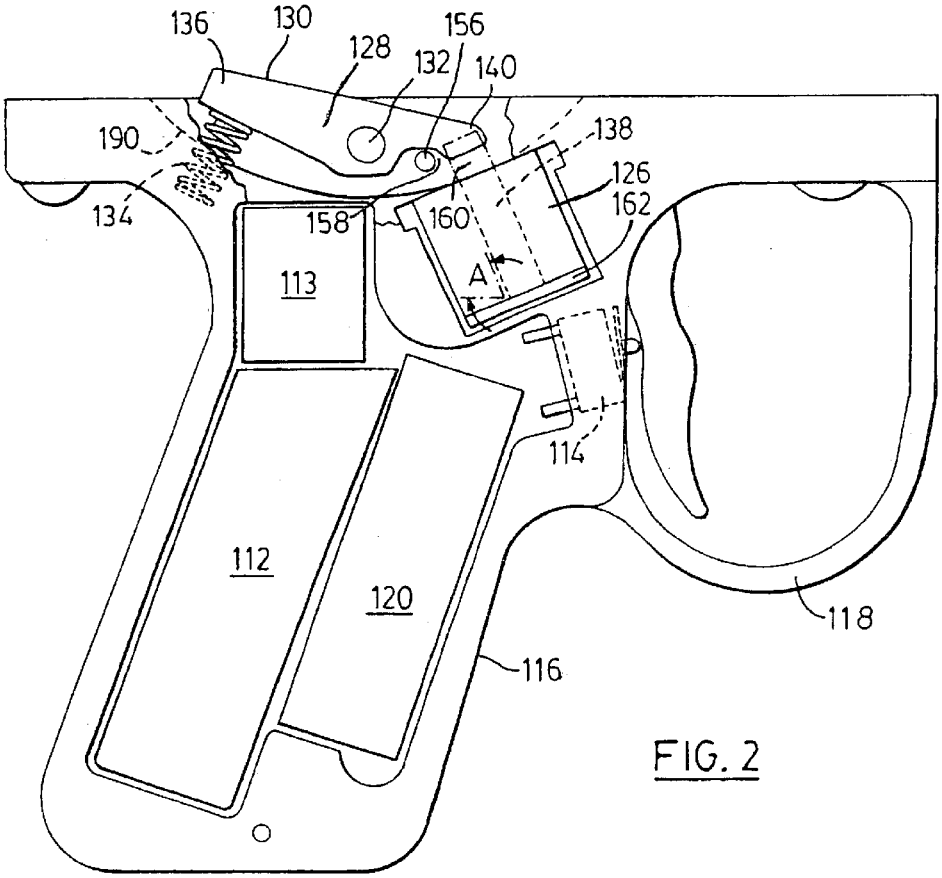
FIG. 2 is a detailed side view of the handle frame of the gun of FIG. 1, this view also illustrating several components mounted therein, including a solenoid and a pivotable sear member.

Returning now to the sear, mechanism of the present invention as illustrated in FIG. 2, this mechanism includes a relief pin 156 that is rigidly mounted in the handle frame which is part of the gun body. The pin is below the sear member and it acts to limit downward pivotable movement of the sear member caused by the spring 134. The sear member can be formed with a bottom recess 158 in which the pin is located when the sear member is in the cocked position shown in FIG. 2. The pin 156 provides the advantage of absorbing the shock that can occur when the gun is fired, a shock that would otherwise be taken up by the solenoid. Another advantage provided by this pin is that it allows for clearance to be provided in the throw of the solenoid 126 and its actuating member 138. This adds momentum to the actuating member's movement, thereby adding greatly to the number of shots which can be obtained on a battery charge. It is estimated that this feature can increase the number of shots from a battery charge by as much as three times (for example, raising the number of shots from 5,000 to 15,000 per battery charge). This arrangement also eliminates the need to periodically adjust the position of the solenoid, thereby improving reliability.

It should be noted here that the actuating member 138 in the solenoid and the sear mechanism (in particular, the sear member) are detached from one another. When the hammer is in its rear cocked position, the actuating member 138 is spaced apart from this sear member a short distance. This gap is indicated at 160 in FIG. 2.

In the preferred embodiment of the invention, the sear engaging member or actuating member 138 is movable linearly along an axis of movement which extends at a substantial acute angle of more than 45° to a central axis of the barrel. This preferred angle is identified as angle A in FIG. 2 and it will be appreciated that the top of the handle frame shown in FIG. 2 is parallel to the central axis of the gun barrel in the preferred gun.

It will be understood that the central, actuating member 138 which can include a circular end plate 162 is movable by the solenoid (when the trigger is pulled) from a lower position shown in FIG. 2 in solid lines to a raised position indicated in dashed lines in FIG. 2. In this way, the actuating member moves the sear mechanism and, in particular, the sear member to release the hammer 72.

Figure 7:
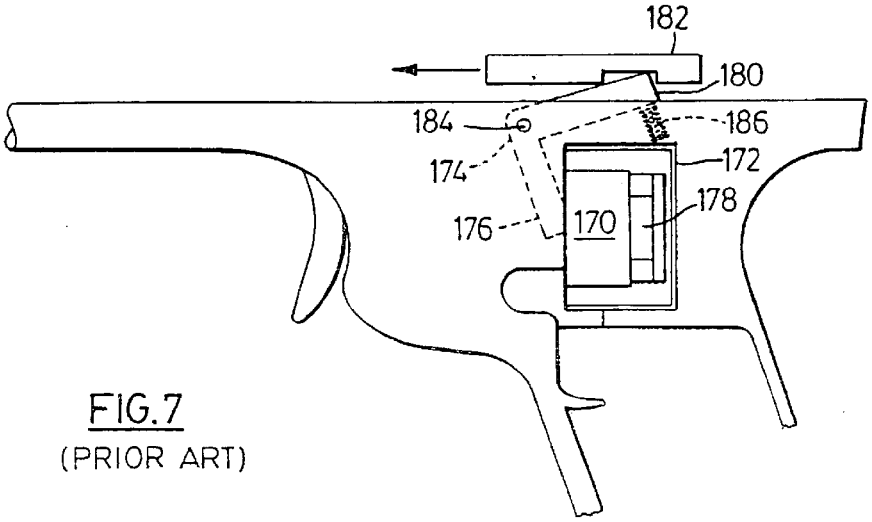
FIG. 7 (PRIOR ART)
FIG. 7 is a schematic illustration of a prior art sear arrangement, a solenoid used to operate this sear and the manner in which it is mounted in the handle frame.

A prior art arrangement for the solenoid and sear member operated by the solenoid is illustrated in FIG. 7. In the prior art gun, the solenoid 170 is arranged in a relatively large, rectangular cavity 172 formed in the handle frame and the central axis of movement of the solenoid extends horizontally. The prior art sear member 174 is in the form of an angle having a downwardly extending leg 176 that is engaged by the actuating member 178 of the solenoid. The sear member also has an upwardly sloping leg 180 and it is the rear end of this leg that engages the hammer 182 in the cocked position. The sear member pivots about a centrally located pivot pin 184 and a coil spring at 186 is used to bias the upwardly projecting end of the sear member. It will be seen from FIG. 7 that in this prior art arrangement and unlike applicant's arrangement, there is no clearance provided between the bottom end of the sear member and the actuating member 178 in the cocked position and thus the solenoid actuating member has no throw when the trigger is pulled and the gun is fired. In other words, the sear member is constantly biased by the spring 186 into contact with the forward end of the actuating member. Also, the sear member in the prior art gun, because of its angular shape, requires a substantial, and deep cavity, in the gun frame in order for it to be accommodated. On the other hand, with applicant's arrangement, the sear member, which is substantially straight from one end thereof to an opposite end thereof and extends generally horizontally, requires only a shallow cavity in the top of the gun frame, this cavity being indicated at 190 in FIG. 2.

Another significant feature of the gun 10 is the construction of the barrel 12 and the manner in which it is mounted in the receiver member 56 which includes the breech section of the gun. The improved barrel arrangement of the present invention employs an extended barrel that includes a rear end section 200 that is rigidly connected to the breech section and in fact extends into the receiver member 56 as illustrated in FIGS. 5 and 6. An open ended ball-receiving chamber 202 is formed in this rear-end section of the barrel. The rear-end section is firmly attached to the receiver member by external threads 204 formed on the barrel and internal threads formed within the front end of the receiver member. As illustrated in FIG. 6, the bolt 74 when advanced to its forward position is able to advance a paintball into the ball-receiving chamber 202, where the ball is in its firing position. Preferably, as shown, the paintball is in fact advanced completely into the rear-end section of the barrel and does not project therefrom. It is also possible that the barrel, the receiving member and the bolt could be constructed so that although the paintball is not completely within the ball-receiving chamber, at least a major section of the ball is located within this chamber, thereby permitting a seal to be created between the front end of the bolt and the ball-receiving chamber.

As indicated above, the bolt 74 is provided with a sealing member mounted on its front end, this sealing member being engageable with the inner surface of the rear-end section of the barrel. The preferred sealing member is an annular seal preferably in the form of the O-ring seal 75 that extends about the circumference of the front end of the bolt. As shown in FIG. 6, the front end of the bolt is slidable into the rear-end section of the barrel so that the O-ring seal can sealingly engage the inner surface of the barrel. Preferably this inner surface of the barrel is machined to close tolerances and the correct diameter so as to form a good seal with the O-ring seal. It will be seen that by extending the barrel rearwardly into the receiver member and thus forming a ball-receiving chamber within the rear end section of the barrel, an effective seal (which is not excessively tight) can be created behind the paintball and this prevents exhaust gases within the barrel from inadvertently traveling rearwardly and up into the ball feed port, the feed tube and the ball hopper. Thus, there is no impediment to the ball loading process created by these gases. This advantage in turn results in the ability of a gun incorporating this feature to employ increased cycle speeds. Furthermore this advantage is gained without causing any drag on the operation of the bolt due to a tight seal between the bolt and the bore of the receiver member. By providing a good seal between the front of the bolt and the rear end of the barrel (which seal is still loose enough not to create an undue drag on the bolt), the hammer will hit the valve stem with the same required force each time a shot is fired.

It will be appreciated by those skilled in the art of constructing gas-powered guns, and particularly guns designed for firing paintballs, that various modifications and changes can be made to a gun that incorporates one or both aspects of this invention without departing from the spirit and scope of this invention. Accordingly, all such modifications and changes as fall within the scope of the appended claims are intended to be part of this invention.

I claim:

1. A gas-powered gun for firing balls dispensed from a magazine into the gun, said gun adapted to be connected to a source of pressurized gas, said gun comprising:

a gun body including a gun handle and a breech section;

a barrel, said breech section being connected to a rear end of said barrel and capable of receiving one ball at a time through a ball feed portion from said magazine;

a bolt slidable within the breech section to advance a ball to a firing position and close off said feed port;

a hammer slidable in a chamber formed in said gun body;

means for biasing said hammer towards a forward firing position;

a trigger movably mounted on said gun body;

an electronic control circuit including a switch operable by said trigger, said circuit being adapted for connection to a power source;

a sear mechanism including an elongate sear member movably mounted in said body and adapted to engage and hold said hammer in a rear, cocked position thereof, said sear member being substantially straight from one end thereof to an opposite end thereof;

a solenoid mounted in said gun body, operated by said control circuit, and adapted to move said sear mechanism so as to release said hammer when said trigger is pulled, said hammer when released sliding rapidly to its forward firing position, said solenoid including a sear engaging member movable from a lowered position corresponding to the cocked position of said hammer to a raised firing position at which said sear member is disengaged from said hammer; and a pressurized gas circuit for delivering pressurized propellant gas from said source to said barrel of the gun for propelling one ball at a time therefrom, said gas circuit including a valve, wherein said hammer when it is moved to its forward firing position strikes said valve to open it, thereby releasing said propellant gas into said barrel.

2. A gas-powered gun according to claim 1 wherein said sear member is pivotably mounted and said sear mechanism includes spring means for biasing said sear member into engagement with said hammer so as to hold said hammer in said rear, cocked position.

3. A gas-powered gun according to claim 2 wherein said sear mechanism includes a pivot pin located at a central section of said sear member, said pivot pin defining a pivot axis about which said sear member can pivot and wherein said spring means engages a rear end section of said sear member while said sear engaging member of the solenoid is positioned to engage a front end section of said sear member.

4. A gas powered gun according to claim 1 wherein said sear engaging member is movable linearly along an axis of movement that extends at a substantial acute angle of more than 45 degrees to a central axis of said barrel.

5. A gas powered gun according to claim 1 wherein said barrel includes a ball-holding open-ended chamber at said rear end thereof and when said ball is advanced to said firing position by said bolt, said ball is positioned at least to a major extent in said chamber in said barrel.

6. A gas-powered gun for firing balls dispensed from a magazine into the gun, said gun adapted to be connected to a source of pressurized gas, said gun comprising:

a gun body including a gun handle and a breech section;

a barrel, said breech section being connected to a rear end of said barrel and capable of receiving one ball at a time through a ball feed port from said magazine;

a bolt slidable within the breech section to advance a ball to a firing position and close off said feed port;

a hammer slidable in a chamber formed in said gun body;

means for biasing said hammer towards a forward firing position;

a trigger movably mounted on said gun body;

an electronic control circuit including a switch operable by said trigger, said circuit being adapted for connection to a power source;

a sear mechanism including a pivotable, elongate sear member movably mounted in said body and adapted to engage and hold said hammer in a rear, cocked position, said sear mechanism further including a pivot pin located at a central location on said sear member, said pivot pin defining a pivot axis about which said sear member can pivot, and spring means for biasing said sear member into engagement with said hammer so as to hold said hammer in said rear, cocked position, said spring means engaging a rear end section of said sear member, said sear mechanism also including a relief pin mounted rigidly in said gun body below said sear member and acting to limit downward pivotal movement of said sear member caused by said spring biasing means;

a solenoid mounted in said gun body, operated by said control circuit, and adapted to move said sear mechanism so as to release said hammer when said trigger is pulled, said hammer when released sliding rapidly to its forward firing position, said solenoid including a sear engaging member movable from a lowered position corresponding to the cocked position of said hammer to a raised firing position at which said sear member is disengaged from said hammer, said sear engaging member of the solenoid being positioned to engage a front end section of said sear member; and a pressurized gas circuit for delivering pressurized propellant gas from said source to said barrel of the gun for propelling one ball at a time therefrom, said gas circuit including a valve, wherein said hammer when it is moved to its forward firing position strikes said valve to open it, thereby releasing said propellant gas into said barrel.

7. A gas powered gun for firing balls dispensed from a magazine into the gun, said gun adapted to be connected to a source of pressurized gas, said gun comprising:

a gun body including a gun handle and a breech section;

a barrel, said breech section being connected to a rear end of said barrel and capable of receiving one ball at a time through a ball feed port from said magazine;

a bolt slidable within the breech section to advance a ball to a firing position and close off said feed port;

a hammer slidable in a chamber formed in said gun body;

means for biasing said hammer towards a forward firing position;

a trigger movably mounted on said gun body;

an electronic control circuit including a switch operable by said trigger, said circuit being adapted for connection to a power source;

a sear mechanism including a sear member pivotably mounted in said body and adapted to hold said hammer in a rear, cocked position thereof, said sear mechanism further including spring means for biasing said sear member into engagement withi said hammer so as to hold said hammer in said rear, cocked position;

a solenoid mounted in said gun body, operated by said control circuit, and adapted to move said sear mechanism so as to release said hammer when said trigger is pulled, said hammer when released sliding rapidly to its forward firing position, said solenoid including a.sear engaging member movable from a lowered position corresponding to the cocked position of said hammer to a raised firing position at which said sear member is disengaged from said hammer, wherein, when said hammer is in said rear, cocked position, said sear engaging member is spaced apart from said sear member a short distance; and a pressurized gas circuit for delivering pressurized propellant gas from said source to said barrel of the gun for propelling one ball at a time therefrom, said gas circuit including a valve, wherein said hammer when it is moved to its forward firing position strikes said valve to open it, thereby releasing said propellant gas into said barrel.

8. A gas-powered gun for firing balls dispensed from a magazine into the gun, said gun adapted to be connected to a source of pressurized gas, said gun comprising:

a gun body including a gun handle and a breech section;

a barrel, said breech section being connected to a rear end of said barrel and capable of receiving one ball at a time through a ball feed port from said magazine, said barrel including a ball-holding open-ended chamber at said rear end thereof;

a bolt slidable within the breech section to advance a ball to a firing position and close off said feed port, said ball being positioned at least to a major extent in said chamber in said barrel when said ball is advanced to said firing position by said bolt, said bolt including an annular seal extending around a front end of the bolt and sealingly engaging said barrel when said bolt is in a forward firing position of the bolt;

a hammer slidable in a chamber formed in said gun body;

means for biasing said hammer towards a forward firing position;

a trigger movably mounted on said gun body;

an electronic control circuit including a switch operable by said trigger, said circuit being adapted for connection to a power source;

a sear mechanism movably mounted in said body and adapted to engage and hold said hammer in a rear, cocked position thereof;

a solenoid mounted in said gun body, operated by said control circuit, and adapted to move said sear mechanism so as to release said hammer when said trigger is pulled, said hammer when released sliding rapidly to its forward firing position, said solenoid including a sear engaging member movable from a lowered position corresponding to the cocked position of said hammer to a raised firing position at which said sear mechanism is disengaged from said hammer; and a pressurized gas circuit for delivering pressurized propellant gas from said source to said barrel of the gun for propelling one ball at a time therefrom, said gas circuit including a valve, wherein said hammer when it is moved to its forward firing position strikes said valve to open it, thereby releasing said propellant gas into said barrel.

9. A gas powered gun according to claim 8 wherein when said ball is advanced to said firing position during use of said gun, said ball is positioned substantially completely in said chamber in said barrel.

10. A gas-powered gun for firing balls comprising:

a gun body including a gun handle and a breech section with an elongate breech chamber formed therein;

a barrel connected to a front end of said breech section;

a bolt slidably mounted in said breech chamber and movable from a rear position for loading a ball into said breech chamber to a front firing position;

a hammer slidably mounted in said gun body, said hammer being slidable from a rear, cocked position to a front firing position;

a spring device for sliding said hammer rapidly to said front firing position when said gun is fired;

a trigger movably mounted on said gun body;

a sear mechanism including an elongate sear member movably mounted on said gun body and adapted to engage and hold said hammer in its rear cocked position until said gun is fired by pulling said trigger, said sear member being substantially straight from one end thereof to an opposite end thereof;

electrical circuit means for moving said sear member to a hammer releasing position, said circuit means including a solenoid mounted in said gun body and a switch operated by said trigger, whereby when said trigger is pulled, said solenoid causes said sear member to be moved and thereby release said hammer for sliding to said front firing position, said solenoid including an actuating member which, when said gun is upright with its barrel extending horizontally, is movable from a lower position to a raised position so that the actuating member moves the sear member to release said hammer; and a pressurized gas circuit for delivering pressurized gas from a source of pressurized gas to said barrel for propelling a ball therefrom when said hammer is moved to its front firing position.

11. A gas-powered gun according to claim 10 wherein said sear member is mounted in said gun body so as to be pivotable about a transverse axis located centrally along the length of the sear member and said actuating member is positioned to engage and move a front end section of said sear member when it is moved to its raised position.

12. A gas-powered gun according to claim 11 wherein said sear mechanism includes a spring arranged to bias said sear member towards its cocking position where the sear member holds said hammer in its rear, cocked position.

13. A gas-powered gun according to claim 12, wherein when said hammer is in its rear, cocked position, said actuating member is spaced apart from said sear member a short distance.

14. A gas-powered gun according to claim 13 wherein said sear mechanism includes a relief pin mounted rigidly in said gun body below a front end section of said sear member, said relief pin acting to limit downward, pivotable movement of said sear member.

15. A gas-powered gun according to claim 13 wherein said hammer is rigidly connected to said bolt for movement therewith and said hammer is formed with a notch on its lower side, a rear end of said sear member engaging a side of said notch when said hammer is in its rear, cocked position.

* * * * *